US005458107A

United States Patent [19]

Balogh et al.

[11] Patent Number: 5,458,107

[45] Date of Patent: Oct. 17, 1995

[54] FLAVOR CIGARETTES

[76] Inventors: Robert J. Balogh, 607 Mohawk Ct., Suffern, N.Y. 10901; George Spector, 233 Broadway Rm 702, New York, N.Y. 10279

[21] Appl. No.: 205,509

[22] Filed: Mar. 4, 1994

[51] Int. Cl.[6] ..... A24D 1/04

[52] U.S. Cl. ..... 131/335; 131/337; 131/339

[58] Field of Search ..... 131/335, 338, 131/339, 361, 362, 344

[56] References Cited

U.S. PATENT DOCUMENTS

| | | | |
|---|---|---|---|
| 3,397,700 | 8/1968 | Harlow et al. | 131/335 X |
| 3,738,375 | 6/1973 | Doumas | 131/338 |
| 4,119,105 | 10/1978 | Owens | 131/338 |
| 4,874,004 | 10/1989 | Borowski et al. | 131/364 |
| 4,924,886 | 5/1990 | Litzinger | 131/194 |
| 5,115,823 | 5/1992 | Keritsis | 131/335 X |

FOREIGN PATENT DOCUMENTS

| | | | |
|---|---|---|---|
| 1579891 | 8/1969 | France | 131/344 |

OTHER PUBLICATIONS

Leffingwill et al., *Tobacco Flavoring for Smoking Products,* RJ Reynolds Tobacco Co. 1972, pp. 63–64.

*Primary Examiner*—Jennifer Bahr

[57] ABSTRACT

An improved flavored cigarette is provided which consists of a cylindrical paper sheet wrapper. Processed tobacco is disposed within the cylindrical paper sheet wrapper. A filter is at one end that is intended to be inserted in the mouth of a smoker. A structure is for supplying a flavor to sweeten the breath of the smoker, when the smoker uses the cigarette in a normal manner.

3 Claims, 1 Drawing Sheet

FLAVOR CIGARETTES

BACKGROUND OF THE INVENTION

The instant invention relates generally to cigarettes and more specifically it relates to an improved flavored cigarette, which provides a structure to sweeten the breath of a smoker.

There are available various conventional cigarettes which do not provide the novel improvements of the invention herein disclosed.

SUMMARY OF THE INVENTION

A primary object of the present invention is to provide an improved flavored cigarette that will overcome the shortcomings of the prior art devices.

Another object is to provide an improved flavored cigarette that is constructed to sweeten the breath of a smoker, while allowing the smoker to use the cigarette in a normal manner.

An additional object is to provide an improved flavored cigarette, in which the flavor can be impregnated into the paper, tobacco or filter, so that when used in the normal manner the flavor will be inhaled by the smoker.

A further object is to provide an improved flavored cigarette that is simple and easy to use.

A still further object is to provide an improved flavored cigarette that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
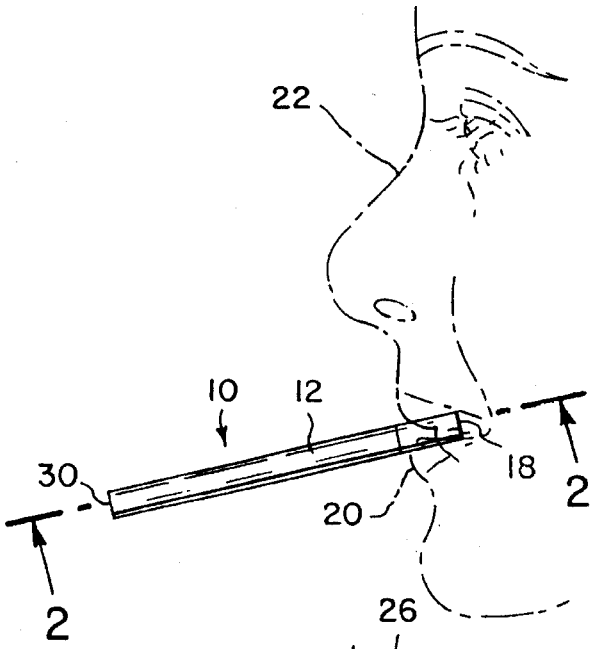
FIG. 1 is a side view of the instant invention with the head of a smoker shown in phantom lines.
Figure 2:
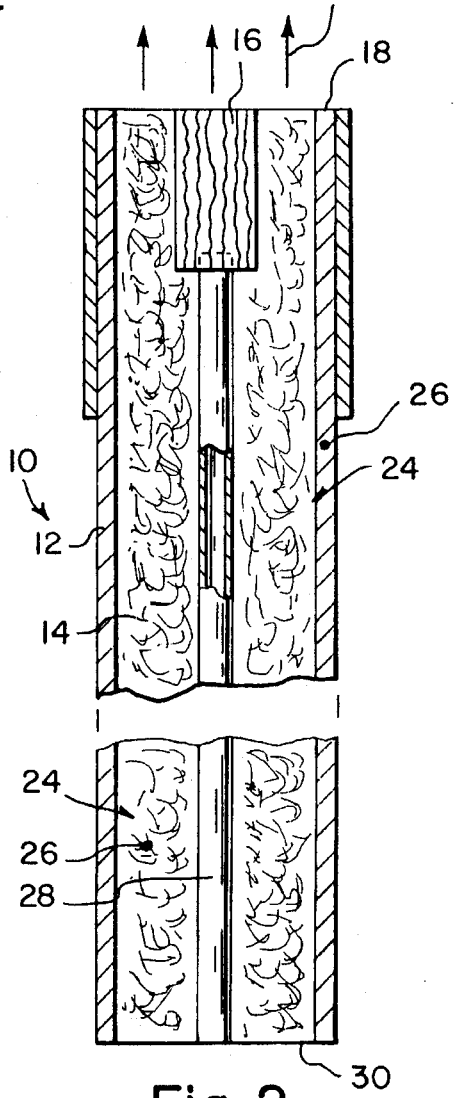
FIG. 2 is an enlarged cross sectional view wit parts broken away taken along line 2—2 in FIG. 1, showing a first embodiment containing a partial filter end with a hollow paper tube extending from the filter to the burn end whereby some of the flavor in the tobacco can bypass the filter into the mouth of the smoker.
Figure 3:
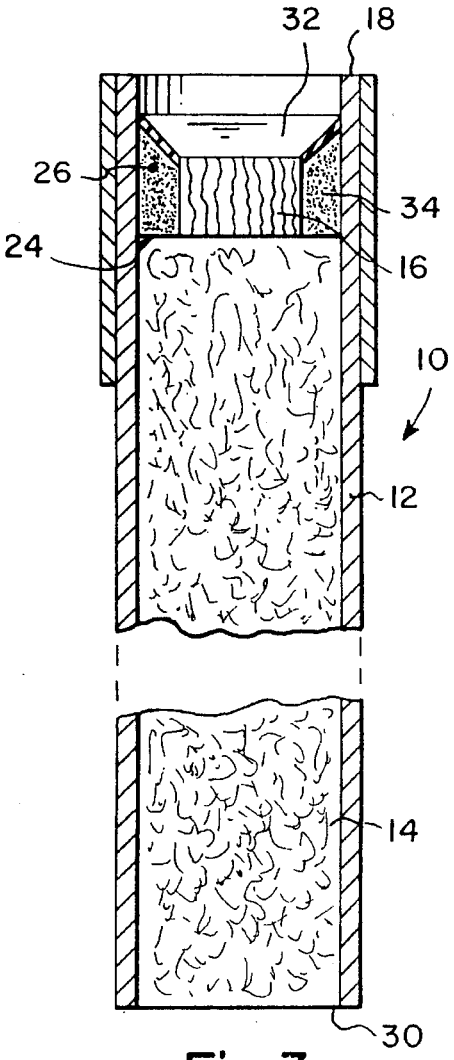
FIG. 3 is an enlarged cross sectional view with arts broken away similar to FIG. 2, showing a second embodiment containing a recessed filter with flavor material about the filter and an annular flap which will open when the smoke is inhaled by the smoker.

Turning now descriptively to the drawings, in which similar reference characters denote similar elements throughout the several views, FIGS. 1 through 3 illustrates an improved flavored cigarette 10, which consists of a cylindrical paper sheet wrapper 12. Processed tobacco 14 is disposed within the cylindrical paper sheet wrapper 12. A filter 16 is at one end 18 that is intended to be inserted in the mouth 20 of a smoker 22. A structure 24 is for supplying a flavor 26 to sweeten the breath of the smoker 22, when the smoker 22 uses the cigarette 10 in a normal manner.

As shown in FIG. 2, the filter 16 is smaller in diameter than the diameter of the processed tobacco 14 in the cylindrical paper sheet wrapper 12. A hollow paper tube 28 extends from a center of the filter 16 to a burn end 30 of the cigarette 10, so that when lit some of the smoke will be filtered through the filter 16.

The flavor supplying structure 24 includes the cylindrical paper sheet wrapper 12 and the processed tobacco 14 impregnated with the flavor 26. When the burn end 30 is let, some of the smoke will bypass the filter 16 and carry some of the flavor 26 to the smoker 22.

As shown in FIG. 3, the filter 16 is recessed and smaller in diameter than the diameter of the processed tobacco 14 in the cylindrical paper sheet wrapper 12. An annular flap valve 32 extends about an upper edge of the filter 16, so that when a burn end 30 is let some of the smoke will be filtered through the filter 16.

The flavor supplying structure 24 includes flavor material 34 positioned about the filter 16 under the annular flap valve 32. When the burn end 30 is lit, some of the smoke will bypass the filter 16 and carry some of the flavor 26 out of the annular flap valve 32 to the smoker 22.

OPERATION OF THE INVENTION

To use the improved flavored cigarette 10, the smoker 22 simply places the filter tip end 18 into the mouth 20. The burn end 30 is then lit. In the construction shown in FIG. 2, some of the smoke will pass through the hollow paper tube 28, go out of the filter 16 and enter the mouth 20. Some of the smoke with the flavor 26 will also bypass the filter 16 and enter the mouth 20 when the smoker 22 inhales.

In the construction shown in FIG. 3, some of the smoke will pass through the filter 16 and enter the mouth 20. Some of the smoke will also go through the flavor material 34, past the opened annular valve flap 32 and enter the mouth 20 when the smoker 22 inhales.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved flavored cigarette with a mouth insertion end and a burn end which comprises:

a) a cylindrical paper sheet wrapper;

b) processed tobacco disposed within said cylindrical paper sheet wrapper;

c) a filter mounted in the first said end;

d) means for filtering some of the smoke and providing a flavor to sweeten the remainder of the smoke when the smoker uses said cigarette in a normal manner; further including:

e) said filter being smaller in diameter than the diameter of said surrounding wrapper enveloping said processed tobacco and f) a hollow paper tube extending from the center of said filter to said burn end of said cigarette, whereby when lit some of the smoke from the burning tobacco will enter the tube and flow through said filter and the remainder of the flavored smoke will pass directly into the users mouth bypassing the filter and providing flavor.

2. An improved flavored cigarette as recited in claim 1, further including:

a) said filter being recessed from said end which is inserted in the user's mouth and smaller in diameter than the diameter of said surrounding processed tobacco in said cylindrical paper sheet wrapper; whereby said filter is annularly spaced from said wrapper;

b) an annular flap valve extending about an upper edge of said filter and engaging said wrapper so that when a burn end is lit some of the smoke will be filtered through said filter and the remainder of said smoke will flow through said valve upon inhalation of the user simultaneous with the smoke flowing through said filter.

3. An improved flavored cigarette as recited in claim 2, wherein said flavor supplying means includes flavor material positioned about said filter under said annular flap valve so that when said burn end is lit, some of the smoke will bypass said filter and carry some of said flavor out of said annular flap valve to the smoker, simultaneous with the smoke flowing through said filter upon inhalation of the user.

* * * * *